US005348236A

United States Patent [19]

Spargo et al.

[11] Patent Number: 5,348,236

[45] Date of Patent: Sep. 20, 1994

[54] IMPELLER ASSEMBLY FOR PROCESSING DEVICE

[75] Inventors: John D. Spargo, Annapolis; John L. Drake, Jr., Arnold, both of Md.

[73] Assignee: The United States of America as represented by the Secretary of the Navy, Washington, D.C.

[21] Appl. No.: 127,545

[22] Filed: Sep. 28, 1993

[51] Int. Cl.[5] ..... B02C 18/12; B02C 18/22

[52] U.S. Cl. ..... 241/46.17; 241/46.11

[58] Field of Search ..... 241/46.01, 46.017, 46.11, 241/46.17, 73, DIG. 38, 46.014, 46.016, 152.2

[56] References Cited

U.S. PATENT DOCUMENTS

| | | | |
|---|---|---|---|
| 3,305,180 | 2/1967 | Tomlinson | 241/46.11 X |
| 4,396,160 | 8/1983 | Riemecker et al. | 241/46.17 |
| 4,460,132 | 7/1984 | Thumm et al. | 241/46.17 X |
| 4,767,069 | 8/1988 | Kim | 241/152.2 |

*Primary Examiner*—Douglas D. Watts

*Attorney, Agent, or Firm*—Gary G. Borda

[57] ABSTRACT

An impeller of an impeller assembly for a processing device has a spiral groove formed in a circumferential side face so that material entering a clearance space between the circumferential side face of the impeller and inner circumferential walls of the processing device is guided out of the clearance space when the impeller assembly is rotated. The spiral groove prevent material from lodging in the space and jamming the impeller assembly.

14 Claims, 4 Drawing Sheets

10'
18
27
24

20'
22'
26
29
32
29
16
28
34
39
38
DRIVE MOTOR
14
12
36
46'

IMPELLER ASSEMBLY FOR PROCESSING DEVICE

BACKGROUND OF THE INVENTION

1. Field of the Invention

The present invention relates to an impeller assembly for a processing device, such as a pulper or grinder of material. More particularly, the present invention relates to an improvement in the impeller of an impeller assembly, which prevents material that is being processed from lodging in a clearance space between the impeller and stationary walls of the processing device that surround the impeller.

2. Description of the Prior Art

Processing devices that include impeller assemblies are well known. For example, impeller assemblies are used in pulping machines for pulping paper and garbage. Such a pulping machine, including an impeller assembly, is manufactured, for example, by Somat Corp., Pomeroy, Pa., 19367-0128.

As shown in FIG. 1, a prior art processing device 10 includes a drive unit 12, a bearing unit 14 for housing a shaft and bearing assembly (not shown), and a processing unit 16. The bearing unit 14 transmits driving force from the drive unit 12 to the processing unit 16 so as to operate the processing unit 16. Such arrangements are well known and, therefore, will not be described in detail here.

The processing unit 16 houses an impeller assembly 18, which includes a generally circular impeller 20 having a circumferential side face 22 extending between a top face 24 and a bottom face 26 of the circular impeller 20. A plurality of blades 27 are attached to the top face 24 of the circular impeller 20. The blades 27 co-act in known fashion with stationary blades 29 provided on the inner circumferential walls of the processing unit 16 so as to pulp or grind the material put into the processing unit 16.

The material to be processed by the processing unit 16 is moved by the impeller 20 toward an outlet (not shown) when the impeller assembly 18 is rotated by the drive unit 12 through the bearing unit 14. The circumferential side face 22 of the impeller 20 is separated from stationary walls 28 of the processing unit 16 by a clearance space 30. The clearance space 30 permits the impeller 20 to rotate freely inside the processing unit 16 when the impeller assembly 18 is rotated by the driving force transmitted by the bearing unit 14 from the drive unit 12. A perforated screen 32 surrounds the impeller assembly 18 and serves as a filter to limit the size of material passing from the processing unit 14 toward the outlet.

In the known impeller assemblies, as shown in FIG. 1, the impeller 20 has a smooth circumferential side face 22. It has been found that the impeller assembly in such processing devices tends to jam or bind up on the material being processed, in particular plastic and elastic materials, and, therefore, overloads the drive unit. The processing device has to be cleaned often and the impeller assembly removed to correct the jamming condition.

SUMMARY OF THE INVENTION

Accordingly, there is a need for an impeller assembly that prevents material from lodging in the clearance space between the impeller and the stationary wall around it.

These and other objects of the present invention may be achieved by an improved impeller assembly for a material processing device. The processing device may have a material receiving area and an outlet for discharge of the material after processing. The impeller assembly is structured and arranged in the processing device so as to be rotatable therein by driving means, the impeller assembly moving the material from the receiving area toward the outlet when the impeller assembly is rotated.

The impeller assembly includes connecting means for being connected with the driving means for rotating the impeller assembly in the processing device; and an impeller member attached for rotation with the connecting means so as to cause the material to move from the receiving area toward the outlet when the impeller assembly is rotated by the driving means. The impeller member being generally circular in shape and having a circumferential face extending between a top and a bottom face of the impeller member, the circumferential face is spaced away from inner circumferential walls of the processing device so as to define a clearance space therebetween. A spiral groove is formed on the circumferential face of the impeller member for guiding material in the clearance space out of the clearance space when the impeller member is rotated.

According to a further object, the invention may comprise a material processing device including driving means and the above-mentioned impeller assembly.

Other features and advantages of the present invention will become apparent from the following description of the invention which refers to the accompanying drawings.

DETAILED DESCRIPTION OF PREFERRED EMBODIMENTS OF THE INVENTION

A processing device having an improved impeller assembly according to the present invention includes certain features that are similar to the prior art processing device previously described. Therefore, similar parts in the processing device according to the present invention will not be described so as to omit unnecessary repetition.

Figures 2, 4:
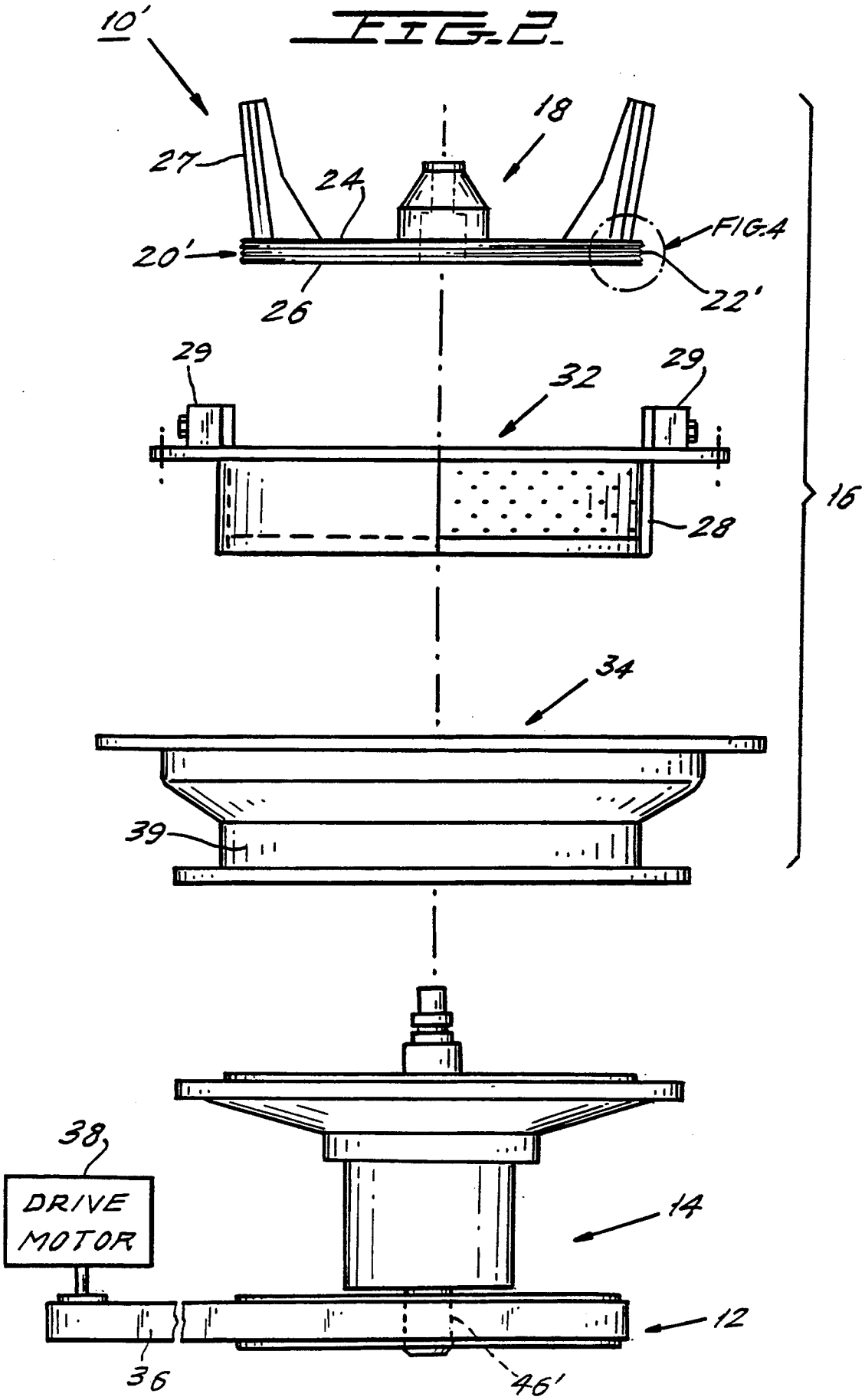
FIG. 2 shows an exploded view of a processing device according to a preferred embodiment of the present invention.
FIG. 4 shows an enlarged detail of the impeller assembly of the processing devices of FIGS. 2 and 3.

As shown in FIG. 2, a processing device 10' according to a first embodiment of the present invention includes an impeller assembly 18, a screen 32, a housing or slurry chamber 34 in which the impeller assembly 18 and the screen 32 fit, and a bearing unit 14 with a drive unit 12 attached to it. The drive unit 12 is connected by a belt 36 to a drive motor 38, shown schematically in FIG. 2. The housing 34 includes an annular outlet chamber 39 for discharging material that has been processed in the processing unit 16.

The impeller assembly 18 includes a generally circular impeller 20' having a top face 24 and a bottom face 26. A circumferential side face 22' connects the top face 24 and the bottom face 26. A spiral or helical groove is formed on the circumferential side face 22' (as shown in FIG. 4). The spiral groove on the circumferential side face 22' of the impeller 20' acts as a screw-type pump. The spiral groove on the circumferential side face 22' encourages and guides material that lodges in the clearance space between the circumferential side face 22' and inner circumferential wall 28 of the screen 32 out of the clearance space when the impeller assembly 18 is rotated.

The spiral groove formed on the circumferential side face 22' acts as a screw-type pump to encourage the material to flow upward through the small gap between the circumferential side face 22' and the inner circumferential wall 28 of the screen 32. The spiral groove may be formed in any suitable or desirable manner. The spiral groove on the circumferential side face may be used to guide material in any direction that is suitable or desirable for the processing unit in which the impeller assembly of the present invention is used and in view of the direction in which the impeller is to be rotated.

Moreover, if larger pieces of solid material are forced into the gap by action of the rotating blades 27, sharp edges of the spiral groove cut the material into smaller pieces which are more readily ejected. The sharp edges of the spiral groove provide a much smaller effective braking area (i.e., the surface area of the circumferential side face that is available for material to lodge and jam against) for any material that does manage to lodge in the clearance space 30 than the smooth flat impeller side face of the impeller 20 of the prior art.

Figure 1:
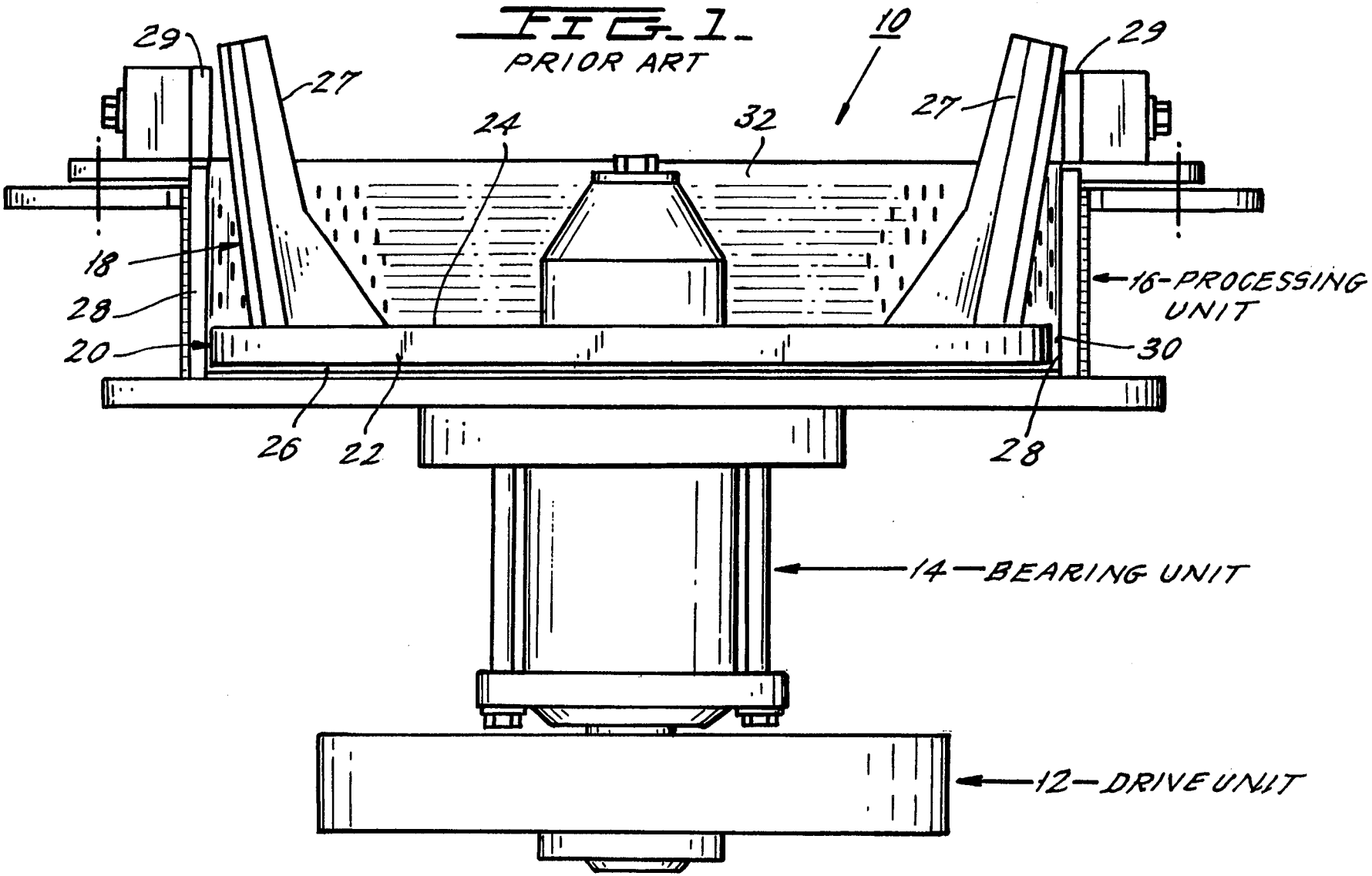
FIG. 1 PRIOR ART
FIG. 1 shows a perspective view of a processing device of the prior art.
Figure 3:
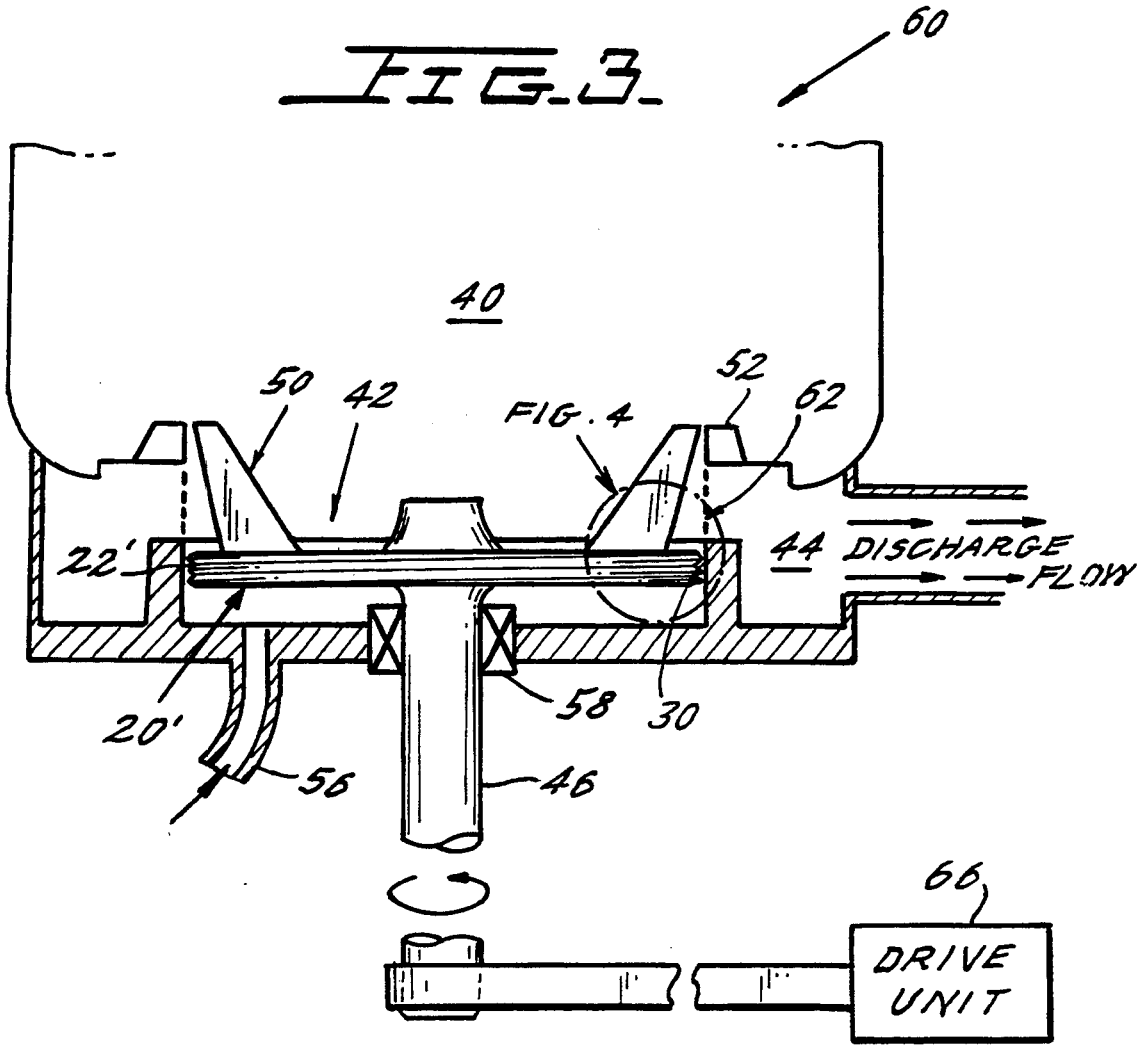
FIG. 3 shows a perspective view of a processing device according to another embodiment of the present invention.
Figure 4:
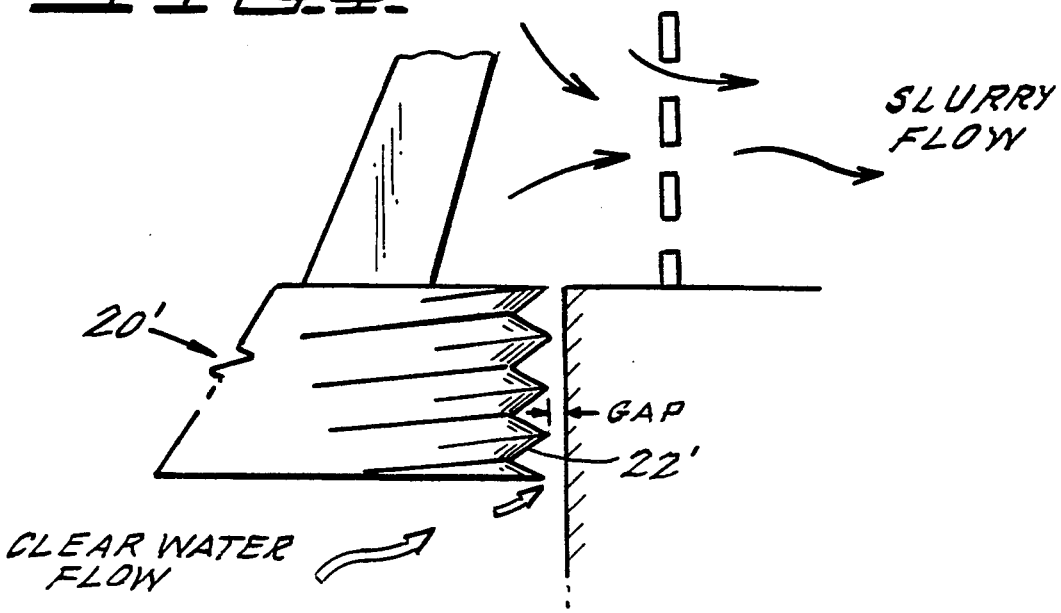

FIG. 3 shows another embodiment with a processing unit 60 having an impeller assembly 42 according to the present invention. The processing unit 60 shown in FIG. 3 is generally similar to those shown in FIGS. 1 and 2. The processing unit 60 in FIG. 3 includes a receiving area 40 for receiving material (not shown) to be processed in the processing unit 60. The impeller assembly 42 is located in the processing unit 60 so that when the impeller assembly 42 is rotated the material in the receiving area 40 is moved from the receiving area 40 toward an outlet 44. The impeller assembly 42 includes a shaft 46, one end of the shaft 46 being connected to a drive unit (shown schematically at 66 in FIG. 3). The other end of the shaft is connected to a generally circular impeller 20'. Seals 58 are provided on the shaft 46 so as to seal the hole in the bottom wall of the processing unit 60 through which the shaft 46 passes.

A top face of the impeller 20' has a plurality of blades 50. The plurality of blades 50 on the top face of the impeller 20' coact with corresponding stationary blades 52 provided on inner circumferential walls of the processing unit 60. In combination, the blades 50, 52 process, i.e., pulp or grind, the material moving from the receiving area 40 to the outlet 44 when the impeller assembly 20' is rotated.

FIG. 4 shows an enlarged detail of the circumferential side face 22' of the impeller 20'. The circumferential side face 22' of the impeller 20' extends between the top face and the bottom face of the impeller 20'. A small gap is formed between the circumferential side face 22' of the impeller 20' and stationary inner circumferential walls of the processing unit. The circumferential side face 22' of the impeller 20' includes a spiral or helical groove formed so as to urge material in the gap upward out of the gap.

As shown in FIG. 3, the bottom face of the impeller 20' is spaced away from an inner bottom wall of the processing unit 60. An inlet 56 is provided in the inner bottom wall of the processing unit 60 so that water may be pumped in through the inlet 56 into the bottom space between the bottom face of the impeller 20' and the inner bottom wall of the processing unit 60. The water flows from the bottom space through clearance space 30 into receiving area 40 for mixing with the material to be processed to form a slurry. The flow of water facilitates movement of the material in the receiving area 40 toward the outlet 44. The water pumped into the bottom space between the bottom face of the impeller 20' and the inner bottom wall of the processing unit 60 also fills a vacuum created in the bottom space by the impeller 20' when the impeller assembly 42 is rotated. A perforated screen 62 is provided at the outlet 44 to filter the material passing from the receiving area 40 toward the outlet 44.

The clearance space 30 between the circumferential side face 22' of the impeller 20' and the fixed walls of the processing unit 60 is preferably about 0.020 inch. The spiral groove formed in the circumferential side face 22' of the impeller 20' may preferably be a thread formed in the circumferential side face 22'. Since it is intended that the spiral groove guide material in the clearance space 30 out of the clearance space 30 when the impeller assembly 42 is rotated, the spiral groove may be formed accordingly. For example, the spiral groove may be formed as a thread on the circumferential side face 22' so that when the impeller assembly 42 rotates material in the clearance space 30 is guided and moved out of the clearance space 30. For example, when the impeller assembly 42 is rotated in a clockwise direction when viewed from above, the spiral groove in the circumferential side face of the impeller may be a right-hand thread to the rotation of the impeller assembly to move material in clearance space 30 upward out of clearance space 30.

The spiral groove formed in the circumferential side face 22' may be of any size suitable or desired. For example, in the instance when the spiral groove is a thread, the size of the thread is determined by the rotational speed of the impeller 42, the size of the material that is to be processed by the processing unit 60 and the desired size of the material that is to be discharged from the outlet 44. The thread formed in the circumferential side face may be four threads to the inch. Preferably, the entire circumferential side face 22' of the impeller 20' is threaded.

Figure 5:
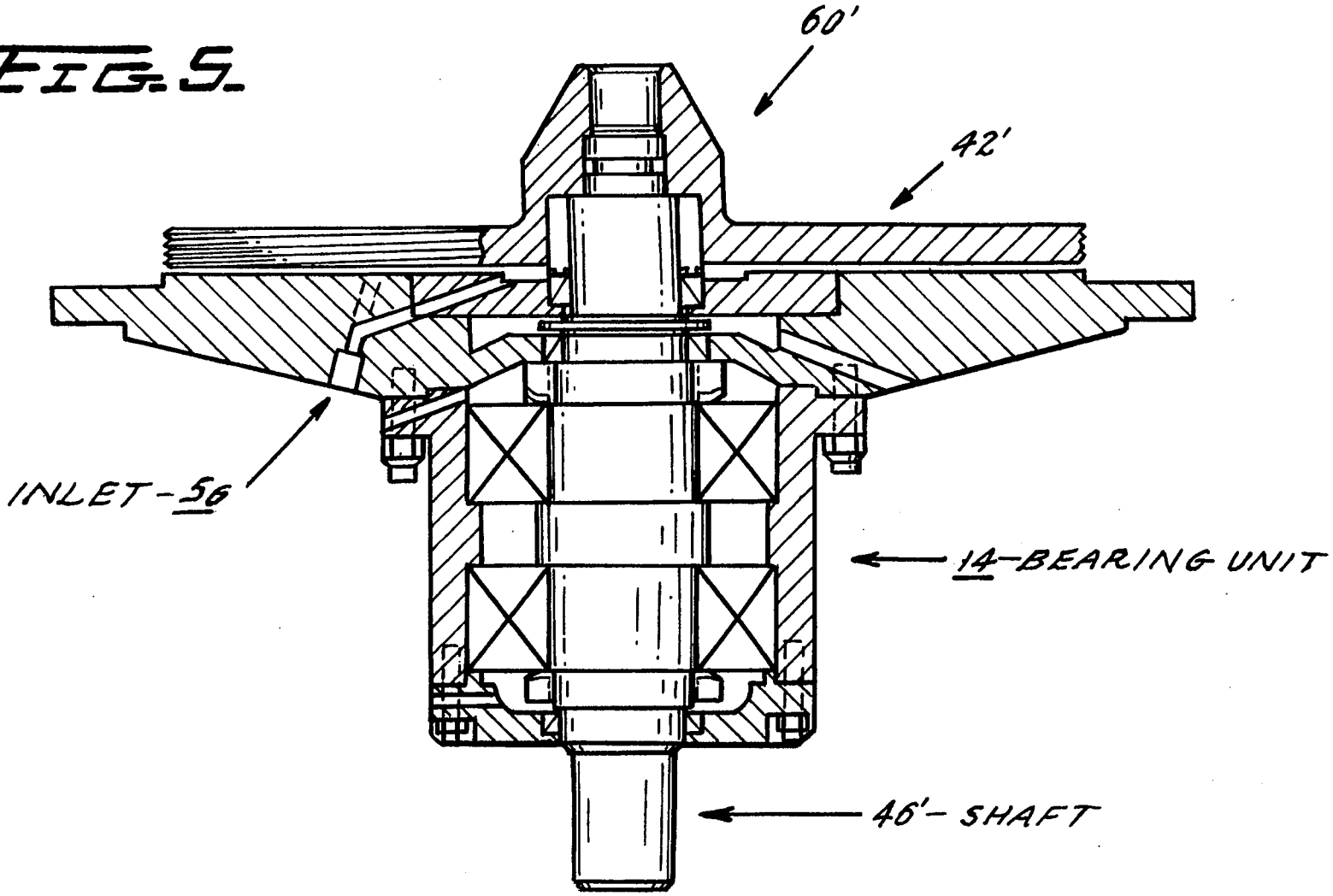
FIG. 5 shows a perspective view of a processing device according to yet another embodiment of the present invention.

FIG. 5 shows yet another embodiment with a processing device 60' having an impeller assembly 42' according to the present invention. As previously discussed above, the processing device 60', shown in FIG. 5, includes a shaft 46' a bearing unit 14, and an impeller assembly 42'. The circumferential side walls of the impeller assembly 42' include a spiral or helical groove.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. An impeller assembly for use in a material processing device of the type capable of processing both paper and plastic materials and having a material receiving area for receiving a material to be processed and an outlet for distance of the material after processing, the impeller assembly being structured and arranged for mounting in the processing device so as to be rotatable therein by driving means, wherein upon being mounted in a material processing device the impeller assembly functions to move the material from the receiving area toward the outlet when the impeller assembly is rotated, the impeller assembly comprising:

(a) connecting means for being connected with the driving means of the material processing device; and (b) an impeller member attached for rotation with said connecting means, said impeller member being generally circular in shape and having a circumferential face extending between a top and a bottom face of said impeller member and a plurality of radially extending blades projecting axially from said top face, said circumferential face of said impeller member having a continuous spiral groove formed thereon, wherein upon being mounted in the material processing device said circumferential face is spaced from an inner circumferential wall of the processing device so as to define a clearance space therebetween, said continuous spiral groove being a thread formed such that upon being mounted in the material processing device and being placed in rotation, material in the clearance space is guided upward out of the clearance space by the action of said thread, whereby said continuous spiral groove functions as a screw-type pump to urge material in the clearance space out of the clearance space when said impeller member is rotated.

2. The impeller assembly of claim 1, wherein said connecting means is a shaft, one end of said shaft being attached to said bottom face of said impeller member, and a second end of said shaft for connecting to the driving means.

3. The impeller assembly of claim 1, wherein said thread in said impeller member is a right-handed thread having about four threads to the inch such that upon said impeller assembly being placed in rotation in a clockwise direction when viewed from above said to face, material in the clearance space is guided upward out of the clearance space by the action of said thread.

4. The impeller assembly of claim 1, wherein said spiral groove is formed on the entire width of said circumferential face of said impeller member.

5. A material processing device including an impeller assembly, the processing device capable of processing both paper and plastic materials and having a material receiving area for receiving the material to be processed and an outlet for discharge of the material after processing, the impeller assembly being structured and arranged in the processing device so as to be rotatable therein, the impeller assembly functioning to move the material from the receiving area toward the outlet when the impeller assembly is rotated, the processing device comprising:

(a) driving means;

(b) connecting means connected with said driving means for rotating said impeller assembly in said processing device;

(c) an impeller member attached for rotation with said connecting means, said impeller member causing the material to move from the receiving area toward the outlet when said impeller assembly is rotated by said driving means, said impeller member being generally circular in shape and having a circumferential face extending between a top and a bottom face of said impeller member and a plurality of radially extending blades projecting axially from said top face, said circumferential face being spaced away from an inner circumferential wall of said processing device so as to define a clearance space therebetween, wherein a spiral groove is formed on said circumferential face of the impeller whereby said spiral groove functions as a screw-type pump impeller to urge material in said clearance space out of said clearance space when said impeller member is rotated; and (d) a perforated screen, said perforated screen being arranged at the outlet to limit the size of material moving from the receiving area to the outlet.

6. The processing device of claim 5, wherein the impeller assembly further comprises processing means for processing the material, said processing means being structured and arranged in the processing device so as to process the material moving from the receiving area toward the outlet.

7. The processing device of claim 6, wherein said processing means comprises said plurality of blades attached to said top face of said impeller member, said plurality of blades coacting with stationary blades provided in the processing device so as to process the material.

8. The processing device of claim 5, wherein said connecting means is a shaft, one end of said shaft being attached to said bottom face of said impeller member, and a second end of said shaft being connected to the driving means.

9. The processing device of claim 5, wherein said bottom face of said impeller member is spaced away from an inner bottom wall of said processing device so as to define a bottom space therebetween, an inlet being provided in said inner bottom wall of said processing device for receiving water therethrough, wherein water entering said bottom space through said inlet flows through said clearance space into the material receiving are for combining with the material to be processed to form a slurry, and further wherein said spiral groove is a thread formed so that when said impeller assembly is rotated material in said clearance space is urged upward out of said clearance space toward the outlet of said processing device.

10. The processing device of claim 5, wherein said circumferential face is spaced away from the inner circumferential walls of the processing device by a distance of about 0.020" so as to form said clearance space.

11. The processing device of claim 5, wherein said driving means rotates said impeller assembly in a clockwise direction when viewed from above said top face, and said spiral groove on said impeller member is a right-handed thread formed so that when said impeller assembly is rotated, material in said clearance space is guided upward out of said clearance space.

12. The processing device of claim 11, wherein said thread in said impeller member is about four threads to the inch.

13. The processing device of claim 5, wherein said spiral groove is formed on the entire width of said circumferential face of said impeller member.

14. The processing device of claim 5, further comprising a slurry chamber, said slurry chamber circumferentially surrounding said impeller member so that said clearance space is formed between said circumferential face of said impeller member and inner circumferential walls of said slurry chamber.

* * * * *